US005173644A

United States Patent [19]

Aoki et al.

[11] Patent Number: 5,173,644

[45] Date of Patent: Dec. 22, 1992

[54] CONVERGENCE CORRECTION APPARATUS

[75] Inventors: Kyousuke Aoki; Shuichirou Maekawa; Kazuhiko Endo, all of Fukushima; Yukio Nakamura, Kanagawa, all of Japan

[73] Assignee: Sony Corporation, Tokyo, Japan

[21] Appl. No.: 848,226

[22] Filed: Mar. 9, 1992

[30] Foreign Application Priority Data

Mar. 13, 1991 [JP] Japan ..... 3-047185

[51] Int. Cl.[5] ..... G09G 1/28; H01J 29/51

[52] U.S. Cl. ..... 315/368.28; 315/368.21

[58] Field of Search ..... 315/368.18, 368.21, 315/368.25, 368.27, 368.28; 335/210, 213

[56] References Cited

U.S. PATENT DOCUMENTS 3,894,276 7/1975 Matsumoto et al. ..... 315/368

*Primary Examiner*—Gregory C. Issing

*Attorney, Agent, or Firm*—Lewis H. Eslinger; Jay H. Maioli

[57] ABSTRACT

A convergence correction apparatus comprising a core for producing a bias magnetic field. The core has first, second, third and fourth coils provided thereon. The first and second coils are wound to produce a magnetic field in a direction opposite to the direction of the bias magnetic field. The third and fourth coils are wound to produce a magnetic field in the same direction as the direction of the bias magnetic field. The first and fourth coils are connected to form a first series circuit connected in parallel with a second series circuit of the third and second coils. A first terminal is connected to a junction between the first and third coils. A second terminal is connected to a junction between the second and fourth coils. A convergence correction coil is connected at one end thereof to a junction between the first and fourth coils and at the other end thereof to a junction between the second and third coils. A horizontal deflection current is applied between the first and second terminals. The bias magnetic field is produced by a bias coil provided on the core and supplied with a vertical synchronization current having a parabolic waveform. Alternatively, the basic magnetic field is produced by a combination of at least one permanent magnet provided on the core and a bias coil provided on the core and supplied with a vertical synchronization current having a parabolic waveform.

2 Claims, 4 Drawing Sheets

FIG. 8
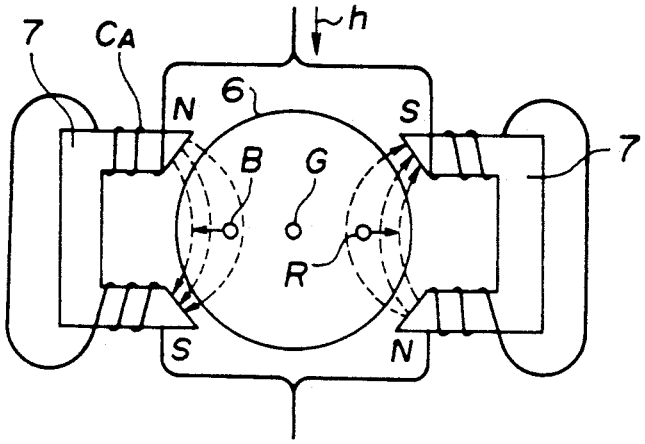
FIG. 9(a)
FIG. 9(b)
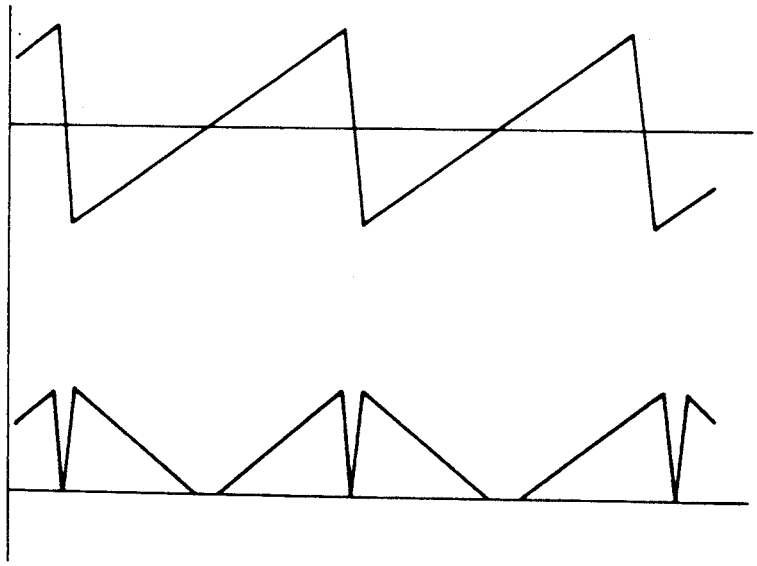

CONVERGENCE CORRECTION APPARATUS

BACKGROUND OF THE INVENTION

This invention relates to an apparatus for convergence correction in a color cathode-ray tube.

For example, Japanese Patent Kokai No. 61-269835 discloses a prior art convergence correction apparatus for use with a color cathode-ray tube. The convergence correction apparatus includes a convergence correction coil for making a convergence correction in the color cathode-ray tube. For this purpose, the convergence correction apparatus includes a simple circuit which converts a horizontal deflection current into an electric current having a parabolic waveform for application to the convergence correction coil. With the prior art convergence correction apparatus, however, the convergence quality is limited as described hereinafter.

SUMMARY OF THE INVENTION

Therefore, it is a main object of the invention to provide an improved convergence correction apparatus which can improve the convergence quality to a great extent.

There is provided, in accordance with the invention, a convergence correction apparatus comprising a core, and a bias coil provided on said core. The bias coil is supplied with a vertical synchronization current having a parabolic waveform for producing a bias magnetic field in a direction. The core has first, second, third and fourth coils provided thereon. The first and second coils are wound to produce a magnetic field in a direction opposite to the direction of the bias magnetic field. The third and fourth coils are wound to produce a magnetic field in the same direction as the direction of the bias magnetic field. The first and fourth coils are connected to form a first series circuit connected in parallel with a second series circuit of the third and second coils. The convergence correction apparatus also includes a first terminal connected to a junction between the first and third coils, and a second terminal connected to a junction between the second and fourth coils. A convergence correction coil is connected at one end thereof to a junction between the first and fourth coils and at the other end thereof to a junction between the second and third coils. A horizontal deflection current is supplied between the first and second terminals.

In another aspect of the invention, there is provided, a convergence correction apparatus comprising a core having at least one permanent magnet provided thereon for producing a first magnetic field in a direction, and a bias coil provided on said core. The bias coil is supplied with a vertical synchronization current having a parabolic waveform for producing a second magnetic field in a direction opposite to the direction of the first magnetic field. The second magnetic field is combined to the first magnetic field to produce a bias magnetic field. The core has first, second, third and fourth coils provided thereon. The first and second coils are wound to produce a magnetic field in a direction opposite to the direction of the first magnetic field. The third and fourth coils are wound to produce a magnetic field in the same direction as the direction of the first magnetic field. The first and fourth coils are connected to form a first series circuit connected in parallel with a second series circuit of the third and second coils. The convergence correction apparatus also includes a first terminal connected to a junction between the first and third coils, and a second terminal connected to a junction between the second and fourth coils. A convergence correction coil is connected at one end thereof to a junction between the first and fourth coils and at the other end thereof to a junction between the second and third coils. A horizontal deflection current is supplied between the first and second terminals.

BRIEF DESCRIPTION OF THE DRAWINGS

This invention will be described in greater detail by reference to the following description taken in connection with the accompanying drawings, wherein like numerals refer to like parts, and in which:

FIG. 8 is a schematic diagram showing the convergence correction yoke used in the prior art convergence correction apparatus of FIG. 7;

FIG. 9(*a*) is a graph showing the waveform of the horizontal deflection current; and FIG. 9(*b*) is a graph showing the waveform of the current supplied to the convergence correction coil.

DETAILED DESCRIPTION OF THE INVENTION

Figure 6:
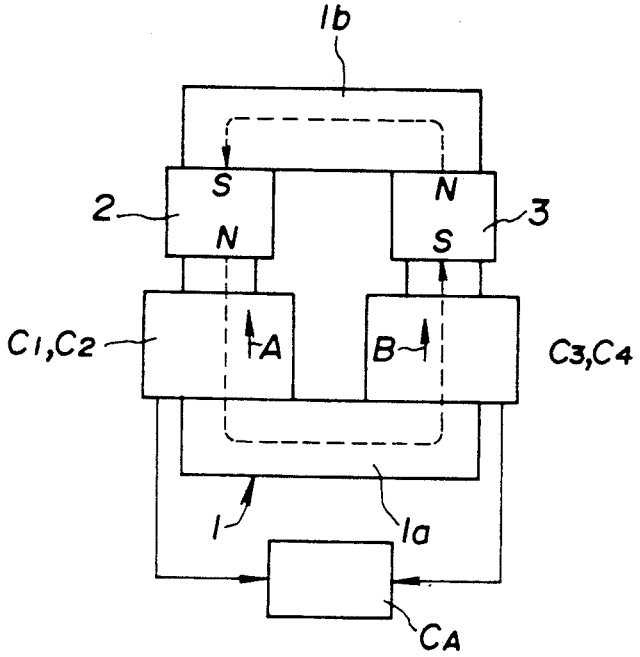
FIG. 6 is a schematic diagram showing a prior art convergence correction apparatus.

Prior to the description of the preferred embodiments of the present invention, the prior art convergence correction apparatus of FIG. 6 is briefly described in order to specifically point out the difficulties attendant thereon.

In FIG. 6, the prior art convergence correction apparatus includes a core 1 comprised of a U-shaped first core piece 1*a* and a rod-shaped second core piece 1*b*. The first core piece 1*a* is fixed at its one end through a permanent magnet 2 to one end of the second core piece 1*b* and at the other end thereof through a permanent magnet 3 to the other end of the second core piece 1*b* so as to form a closed magnetic path. The permanent magnets 2 and 3 are directed to produce a bias magnetic field in the same direction. The first core piece 1*a* has first and second coils C1 and C2 provided on its one arm portion and third and fourth coils C3 and C4 provided on the other arm portion thereof. The first and second coils C1 and C2 are wound on a coil bobbin (not shown) in a bifilar winding fashion to have the same magnetic characteristic. Similarly, the third and fourth coils C3 and C4 are wound on a coil bobbin (not shown) in a bifilar winding fashion to have the same magnetic characteristic. The first and second coils C1 and C2 may be wound to produce a magnetic field in a direction opposite to the direction of the magnetic field produced by the permanent magnets 2 and 3, whereas the third and fourth coils C3 and C4 are wound to produce a magnetic field in the same direction as the direction of the magnetic field produced by the permanent magnets 2 and 3. as shown in FIG. 6. Alternatively, the first and second coils C1 and C2 may be wound to produce a magnetic field in the same direction as the direction of the magnetic field produced by the permanent magnets 2 and 3, whereas the third and fourth coils C3 and C4 are wound to produce a magnetic field in a direction opposite to the direction of the magnetic field produced by the permanent magnets 2 and 3.

Figure 7:
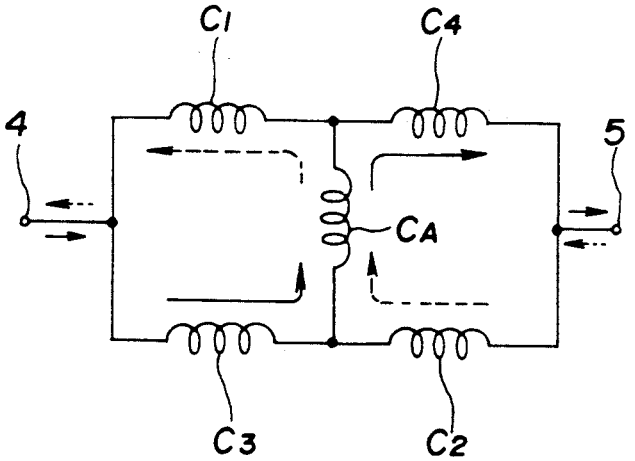
FIG. 7 is a circuit diagram showing an equivalent circuit for the prior art convergence correction apparatus of FIG. 7.

Referring to FIG. 7, there is illustrated an equivalent circuit for the prior art convergence correction circuit of FIG. 6. The equivalent circuit includes a first series circuit of the first and fourth coils C1 and C4 and a second series circuit of the third and second coils C3 and C2. The first and second series circuits are connected in parallel with each other. The junction between the first and third coils C1 and C3 is connected to a first terminal 4. The junction between the fourth and second coils C4 and C2 are connected to a second terminal 5. A convergence correction coil CA is connected at its one end to the junction between the first and fourth coils C1 and C4 and at the other end thereof to the junction between the third and second coils C3 and C2.

Referring to FIG. 8, the convergence correction coil CA is wound on a pair of cores 7 placed, in a convergence correction yoke, on the opposite sides of the neck portion of a color cathode-ray tube. The convergence correction coil CA is wound in such a direction so as to polarize the cores 7 in the illustrated direction to shift the side beams B and R in the outward direction when current flows through the convergence correction coil CA in a direction indicated by the arrow h.

The operation is as follows: A horizontal deflection current, as shown in FIG. 9(*a*), is produced from a current source connected between the first and second terminals 4 and 5. When current flows in the direction indicated in FIG. 7 by the solid arrows, the first and second coils C1 and C2 produce a magnetic flux in a direction, indicated in FIG. 6 by the character A, opposite to the direction of the bias magnetic flux, whereas the third and fourth coils C3 and C4 produces a magnetic flux in the same direction, indicated in FIG. 6 by the character B, as the direction of the bias magnetic flux. The magnetic flux, which is produced by the first and second coils C1 and C2 in the direction opposite to the direction of the bias magnetic flux, decreases to increase the inductance of the first and second coils C1 and C2. The magnetic flux, which is produced by the third and fourth coils C3 and C4 in the same direction as the direction of the bias magnetic flux, increases to decrease the inductance of the third and fourth coils C3 and C4. As a result, current will flow from the first terminal 4 to the second terminal 5 through the third coil C3, the convergence correction coil CA and the fourth coil C4, as indicated by the solid arrows.

When current flows in the direction indicated in FIG. 7 by the broken arrows, the first and second coils C1 and C2 produce a magnetic flux in the same direction, indicated in FIG. 6 by the character A, as the direction of the bias magnetic flux, whereas the third and fourth coils C3 and C4 produces a magnetic flux in a direction, indicated in FIG. 6 by the character B, opposed to the direction of the bias magnetic flux. The magnetic flux, which is produced by the first and second coils C1 and C2 in the same direction as the direction of the bias magnetic flux, increases to decrease the inductance of the first and second coils C1 and C2. The magnetic flux, which is produced by the third and fourth coils C3 and C4 in the direction opposite to the direction of the bias magnetic flux, decreases to increase the inductance of the third and fourth coils C3 and C4. As a result, current will flow from the first terminal 4 to the second terminal 5 through the second coil C2, the convergence correction coil CA and the first coil C1, as indicated by the broken arrows.

It is, therefore, apparent that the current flows through the convergence correction coil CA always in one direction, as shown in FIG. 7, regardless of the direction of the horizontal deflection current. For this reason, the current flowing through the convergence correction coil CA has a waveform similar to a parabolic waveform, as shown in FIG. 9(*b*). The current flow through the convergence correction coil CA is directed in the same direction as the direction indicated in FIG. 8 by the character h to produce a correction magnetic field so as to correct the horizontal miss convergence.

Since the parabolic currents flowing through the convergence correction coil CA are of the same level for the respective vertical lines, however, only a uniform correction can be made for the vertical direction. It is, therefore, impossible to improve the convergence quality, for example, by a vertical miss convergence correction made at and near the center of the screen of the color cathode-ray tube with a horizontal miss convergence correction made at and near the periphery thereof rather than the center thereof.

Furthermore, with the prior art convergence correction circuit, it is impossible to improve the convergence quality since the optimum extent to which a miss convergence correction is made at the periphery of the screen of the color cathode-ray tube is different from the optimum extent to which a miss convergence correction is made at and near the center thereof.

Figure 1:
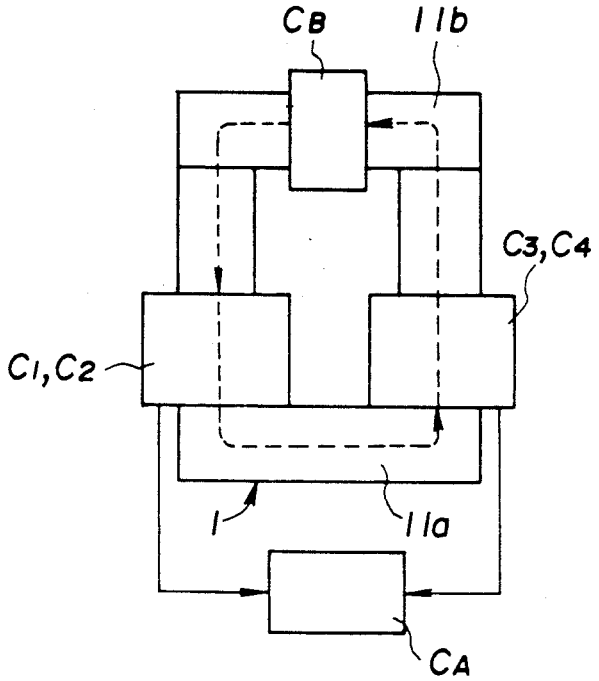
FIG. 1 is a schematic diagram showing a first embodiment of a convergence correction apparatus made in accordance with the invention.

Referring to FIG. 1, there is illustrated a schematic diagram of a convergence correction apparatus embodying the invention. The convergence correction apparatus includes a core 11 comprised of a U-shaped first core piece 11*a* and a rod-shaped second core piece 11*b* secured on the first core piece 11*a* to make an electrical connection between the opposite ends of the first core piece 11*a* so as to form a closed magnetic path. The first core piece 11*a* has first and second coils C1 and C2 wound around a bobbin (not shown) provided on its one arm portion and third and fourth coils C3 and C4 wound around a bobbin (not shown) provided on the other arm portion thereof. The coils C1, C2, C3 and C4 are substantially the same as described in connection with FIG. 6. The second core piece 11*b* has a bias coil CB wound on a bobbin (not shown) provided thereon. A vertical synchronization current having a parabolic waveform is supplied to the bias coil CB to produce a bias magnetic field in a direction indicated in FIG. 1 by the broken line. This bias magnetic field corresponds to the parabolic waveform.

Figure 2:
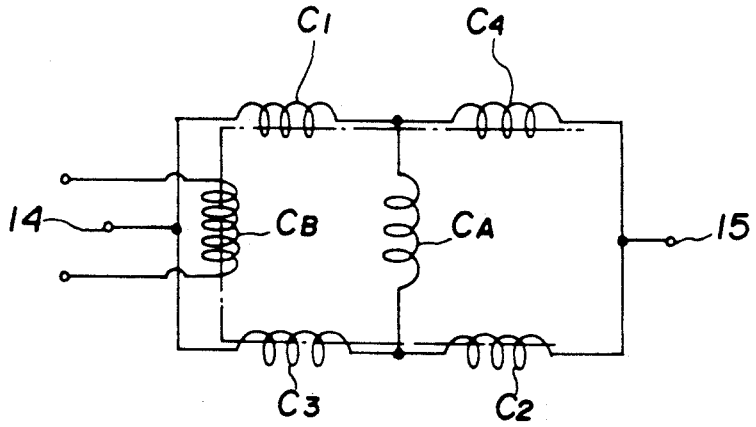
FIG. 2 is a circuit diagram showing an equivalent circuit for the convergence correction apparatus of FIG. 1.

Referring to FIG. 2, there is illustrated an equivalent circuit for the convergence correction apparatus of FIG. 1. The equivalent circuit includes a first series circuit of the first and fourth coils C1 and C4. The first series circuit is connected in parallel with a second series circuit of the third and second coils C3 and C2. The junction between the first and third coils C1 and C3 is connected to a first terminal 14. The junction between the fourth and second coils C4 and C2 are connected to a second terminal 15. The convergence correction coil CA is connected at its one end to the junction between the first and fourth coils C1 and C4 and the other end thereof to the junction between the third and second coils C3 and C2. A source of horizontal deflection current is connected between the first and second terminals 14 and 15. The bias coil CB is coupled magnetically to vary the inductances of the first, second, third and fourth coils C1, C2, C3 and C4 with variations in the level of the vertical synchronization current supplied to the bias coil CB.

Figure 3:
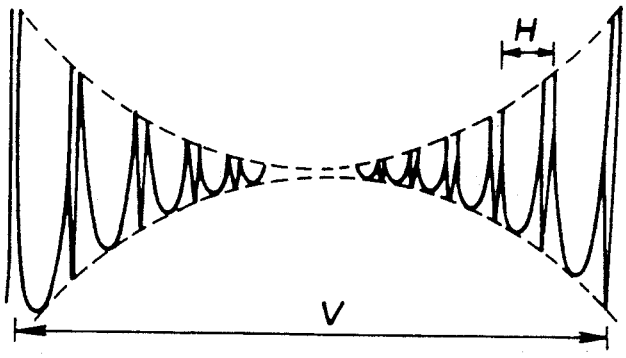
FIG. 3 is a graph showing the waveform of the current supplied to the convergence correction coil.

The operation is as follows: When a horizontal deflection current, as shown in FIG. 9(*a*), is produced from the current source connected between the first and second terminals 14 and 15, a horizontal synchronization current having a parabolic waveform is supplied to the convergence correction coil CA substantially in the same manner as described in connection with the prior art apparatus. The bias coil CB is supplied with a vertical synchronization current having a parabolic waveform to modulate the bias magnetic field. As a result, the current through the convergence correction coil CA has a waveform, as shown in FIG. 3, to make a convergence correction. Substantially no horizontal miss convergence correction is made at and near the center of the screen of the color cathode-ray tube. The degree to which a horizontal convergence correction is made increases as going toward the periphery of the screen of the color cathode-ray tube. Consequently, the convergence correction apparatus of this embodiment is effective to independently correct the horizontal miss convergence at and near the periphery of the screen of the color cathode-ray tube. It is, therefore, possible to improve the convergence quality to a great extent by correcting the vertical miss convergence at and near the center of the screen of the cathode-ray tube and correcting the horizontal miss convergence at and near the periphery of the screen of the cathode-ray tube.

Figure 4:
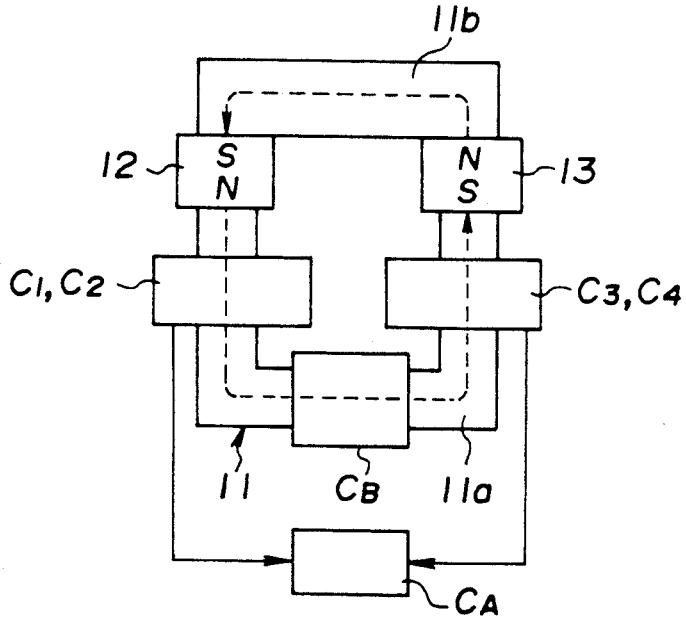
FIG. 4 is a schematic diagram showing a second embodiment of the convergence correction apparatus of the invention.

Referring to FIG. 4, there is illustrated a second embodiment of the convergence correction apparatus of the invention. The arrangement of FIG. 4 utilizes a number of the components previously described, and like reference numerals in FIG. 4 indicate like parts as described with reference to FIGS. 1-3. In this embodiment, the convergence correction apparatus includes a core 11 comprised of a U-shaped first core piece 11*a* which is fixed at its one end through a permanent magnet 12 to one end of a rod-shaped second core piece 11*b* and at the other end thereof through a permanent magnet 13 to the other end of the second core piece 11*b* so as to form a closed magnetic path. The permanent magnets 12 and 13 are directed to produce a bias magnetic field in the same direction. The first core piece 11*a* has first and second coils C1 and C2 wound around a bobbin (not shown) provided on its one arm portion, third and fourth coils C3 and C4 wound around a bobbin (not shown) provided on the other arm portion thereof, and a bias coil CB wound around a bobbin (not shown) provided on its center portion intermediate between the arm portions thereof. The coils C1, C2, C3 and C4 are substantially the same as described in connection with FIG. 6. The bias coil CB is supplied with a vertical synchronization current having a parabolic waveform to produce a bias magnetic field in a direction opposite to the direction of the magnetic field produced by the permanent magnets 12 and 13. Consequently, the produced bias magnetic field, which corresponds to a combination of the magnetic field produced by the permanent magnets 12 and 13 and the magnetic field produced by the bias coil CB, has a waveform inverted parabolic waveform.

Figure 5:
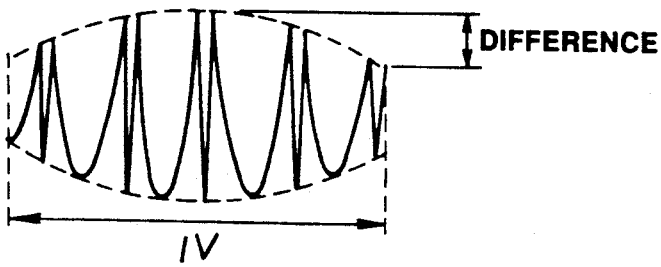
FIG. 5 is a graph showing the waveform of the current supplied to the convergence correction coil.

The operation is as follows: When a horizontal deflection current, as shown in FIG. 9(*a*), is produced from the current source connected between the first and second terminals 14 and 15, a horizontal synchronization current having a parabolic waveform is supplied to the convergence correction coil CA substantially in the same manner as described in connection with the prior art apparatus of FIG. 6. The convergence correction coil CA is influenced by the bias magnetic field produced by the permanent magnets 12 and 13 and the bias coil CB. As a result, the current through the convergence correction coil CA has a waveform, as shown in FIG. 5, to make a convergence correction. That is, a difference can be produced between the correction dynamic range at the center of the screen of the color cathode-ray tube and the correction dynamic range at the periphery of the screen of the color cathode-ray tube. This difference can be utilized to provide a good balance between the degree of correction at and near the center of the screen of the cathode-ray tube and the degree of correction at and near the periphery of the screen of the cathode-ray tube. It is, therefore, possible to improve the convergence quality to a great extent by improving the characteristic at and near the center of the screen of the cathode-ray tube to provide an optimum degree to which correction is made at and near the periphery of the screen of the cathode-ray tube.

While this invention has been described in conjunction with specific embodiment thereof, it is evident that many alternatives, modifications and variations will be apparent to those skilled in the art. Accordingly, it is intended to embrace all alternatives, modifications and variations that fall within the scope of the appended claims.

What is claimed is:

1. A convergence correction apparatus comprising:

a core;

a bias coil provided on said core, the bias coil being supplied with a vertical synchronization current having a parabolic waveform for producing a bias magnetic field in a direction;

first, second, third and fourth coils provided on said core, said first and second coils being wound to produce a magnetic field in a direction opposite to the direction of said bias magnetic field, said third and fourth coils being wound to produce a magnetic field in the same direction as the direction of said bias magnetic field, said first and fourth coils being connected to form a first series circuit connected in parallel with a second series circuit of said third and second coils;

a first terminal connected to a junction between said first and third coils;

a second terminal connected to a junction between said second and fourth coils;

a convergence correction coil connected at one end thereof to a junction between said first and fourth coils and at the other end thereof to a junction between said second and third coils; and means for supplying a horizontal deflection current between said first and second terminals.

2. A convergence correction apparatus comprising:

a core having at least one permanent magnet provided thereon for producing a first magnetic field in a direction;

a bias coil provided on said core, said bias coil being supplied with a vertical synchronization current having a parabolic waveform for producing a second magnetic field in a direction opposite to the direction of said first magnetic field, said second magnetic field being combined to said first magnetic field to produce a bias magnetic field;

first, second, third and fourth coils provided on said core, said first and second coils being wound to produce a magnetic field in a direction opposite to the direction of said first magnetic field, said third and fourth coils being wound to produce a magnetic field in the same direction as the direction of said first magnetic field, said first and fourth coils being connected to form a first series circuit connected in parallel with a second series circuit of said third and second coils;

a first terminal connected to a junction between said first and third coils;

a second terminal connected to a junction between said second and fourth coils;

a convergence correction coil connected at one end thereof to a junction between said first and fourth coils and at the other end thereof to a junction between said second and third coils; and means for supplying a horizontal deflection current between said first and second terminals.

* * * * *